United States Patent [19]

Kent

[11] 4,355,295

[45] Oct. 19, 1982

[54] METHOD AND DEVICE FOR CONNECTING TERMINALS OF A TRAFFIC CONTROL UNIT

[75] Inventor: Willard L. Kent, Austin, Tex.

[73] Assignee: Gulf & Western Manufacturing Company, Southfield, Mich.

[21] Appl. No.: 206,442

[22] Filed: Nov. 13, 1980

[51] Int. Cl.[3] ..... G08G 1/00; H01R 9/00; G08B 5/36

[52] U.S. Cl. ..... 340/41 R; 339/18 R; 339/198 R; 340/815.20

[58] Field of Search ..... 340/41 R, 41 A, 366 E; 339/198 R, 198 G, 198 GA, 18 C, 18 P

[56] References Cited

U.S. PATENT DOCUMENTS

| | | | |
|---|---|---|---|
| 2,787,773 | 4/1957 | Potter | 339/198 R |
| 3,257,642 | 6/1966 | Lazerges | 340/41 R |
| 3,886,496 | 5/1975 | Spilo et al. | 340/41 R |
| 4,001,797 | 1/1977 | Buss et al. | 339/198 R |
| 4,061,902 | 12/1977 | Battle | 364/436 |

*Primary Examiner*—Glen R. Swann, III

*Attorney, Agent, or Firm*—Meyer, Tilberry & Body

[57] ABSTRACT

A method of allowing for manual connection of electrical terminals of several separate and distinct electrical devices mounted at a selected location and used jointly to control signals displayed at a traffic intersection, comprises the steps of fixing a number of junction blocks on a common display panel, permanently connecting the terminals of the separate devices to selected ones of the junction blocks in a positional pattern not dictated by the origin device of the terminals and releasably connecting selected ones of said junction blocks at said display panel to adjust the hardwired operation or program of the separate and distinct electrical devices as they are used to control traffic at the aforementioned intersection. This method can be accomplished by providing each junction block on the common display panel with a first element adapted to be permanently wired to a selected one of the terminals, a connector receiving second element adapted to be connected to a second element of another junction block on the panel and means for electrically connecting the first element and the second connector receiving element of each block. In this manner, the blocks present connectable structures which can be hardwired at the front of the control panel to provide desired operation of the traffic control unit in accordance with the method set forth above.

9 Claims, 15 Drawing Figures

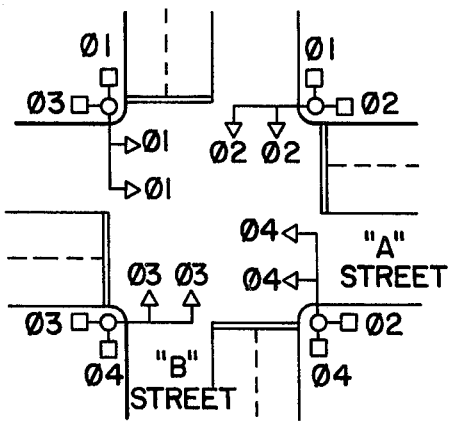
FIG. 5
FIG. 6
SIGNAL SEQUENCE
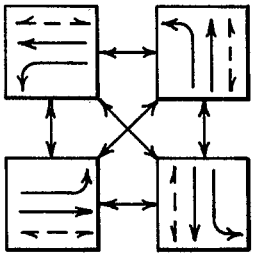
FIG. 7
(PRIOR ART)
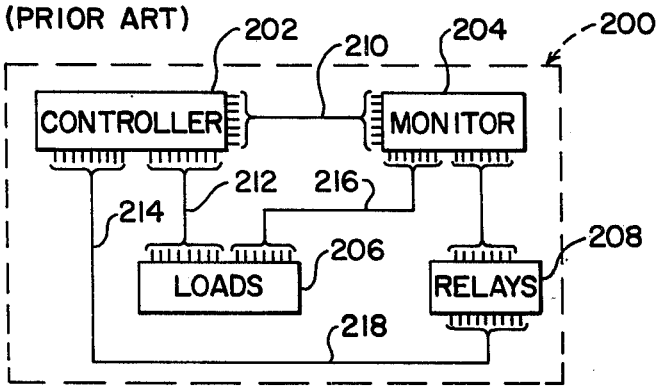

FIG. 9B

| | | |
|---|---|---|
| J | MIN. RECALL | A18 |
| K | MAN. CONT. EN. | A17 |
| M | NON-ACT. 1 | A35 |
| N | TEST A | A13 |
| P | AC + CONTROL | A42 |
| Q | SPARE 1 | * |
| R | STATUS BIT B (I) | B20 |
| S | Ø1 GREEN | C8 |
| T | Ø1 WALK | C16 |
| U | Ø1 CHECK | C2 |
| V | Ø2 PED OMIT | A10 |
| W | OMIT RED CL. (I) | B23 |
| X | RED REST (I) | B22 |
| Y | SPARE 2 | * |
| Z | NON-ACT 2 | A36 |
| AA | TEST B | A14 |
| BB | WLK RST MOD | A34 |
| CC | STATUS BIT A (I) | B19 |
| DD | Ø1 ON | C1 |
| EE | Ø1 PED OMIT | A9 |
| FF | PED RECYCLE (I) | B24 |
| GG | MAX 2 (I) | B26 |
| HH | SPARE 3 | * |

| | | |
|---|---|---|
| K | RESERVED 8Ø | * |
| M | RESERVED 8Ø | * |
| N | RESERVED 8Ø | * |
| P | OL A YELLOW | C15 |
| Q | OL A RED | C12 |
| R | Ø3 CHECK | E2 |
| S | Ø3 ON | E1 |
| T | Ø3 NEXT | E3 |
| U | OL D RED | F12 |
| V | SPARE 4 | * |
| W | OL D GREEN | F18 |
| X | Ø4 PED OMIT | A12 |
| Y | SPARE 5 | * |
| Z | RESERVED 8Ø | * |
| AA | OL A GREEN | C18 |
| BB | OL B YELLOW | D15 |
| CC | OL B RED | D12 |
| DD | OL C RED | E12 |
| EE | OL D YELLOW | F15 |
| FF | OL C GREEN | E18 |
| GG | OL B GREEN | D18 |
| HH | OL C YELLOW | E15 |

METHOD AND DEVICE FOR CONNECTING TERMINALS OF A TRAFFIC CONTROL UNIT

The present invention relates to the art of traffic control and more particularly to a method and device for connecting terminals of a traffic control unit.

The invention is particularly applicable for interconnecting the controller, monitor, load switches, flash relays, flashers and signal terminals of a traffic control unit at an intersection and it will be described with particular reference thereto; however, it is appreciated that the invention has broader applications and may be used for connecting the terminals of various traffic control components mounted at a given location, such as in a cabinet at the intersection.

BACKGROUND OF INVENTION

Controlling traffic at an intersection, especially intersections having several movements of traffic therethrough, has been accomplished by different types of traffic control units. Basically, a traffic control unit allocates signal duration to various traffic movements in a selected sequence so that each movement can have access through the intersection. Ideally, access through the intersection by the several movements should be controlled in a manner to handle efficiently the traffic load at the intersection and prevent undue congestion. As illustrated in U.S. Pat. No. 3,886,496 traffic control units now use digital computers or other digital control devices. When using such digital controllers, it is still necessary to interconnect the controller with a monitor, load switches, and signal controlling devices. In addition, it is often necessary to provide a coordinator to tie intersection controllers with a master system. Such an arrangement is generally illustrated in U.S. Pat. No. 4,061,902. Irrespective of the components involved at the intersection, there is presented a substantial problem in the mechanical arrangement for interconnecting the various analog and digital components used to control the signalization at the intersection. The problem is the cost of actually interconnecting the components. These components are generally interconnected at the manufacturer's plant. This involves a substantial cost factor in the expense of the total traffic control unit. At one time, the various devices combined to form the traffic control unit were interconnected by cable harnesses which were installed prior to shipment for ultimate use at an intersection. These interconnecting harnesses did allow flexibility in changing the connections and in tying connections together for the purpose of changing the general function of the control unit at the intersection. However, this type of connecting arrangement was expensive. The cost did not justify the advantage of being able to change the hardwired interconnection between the devices subsequent to installation. To reduce the cost and be competitive in the marketplace, it has been suggested that various components be permanently wired together without any exposed terminals. Such a procedure did not allow for changing the hardwired interconnection between various terminals of the several devices comprising the total traffic control unit. Such a permanently wired device did reduce the cost of the unit; however, there was little versatility and a traffic engineer could not modify the operation of the unit to any substantial degree after it was installed at the intersection.

THE INVENTION

In accordance with the present invention, there is a method and unit for interconnecting terminals of traffic control components, which method and unit realizes the low cost of hardwired, inflexible interconnecting systems with the versatility of the harness type of system. The invention allows rearranging of the interconnection between various terminals of the several components used in formulating a total traffic control unit at an intersection.

In accordance with the present invention, there is provided a method of allowing for manual connection of electrical terminals of several separate and distinct electrical devices mounted at a selected location and used jointly to control signals displayed at a traffic intersection. This method involves fixing a number of junction blocks onto a common display panel, permanently connecting the terminals of the devices to selected ones of the junction blocks in a positional pattern not dictated by the origin device of the terminals and releasably connecting selected ones of the junction blocks at the display panel to adjust the hardwired program of the separate and distinct electrical devices from a position at the front of the display panel.

By using this type of arrangement, the various components are hardwired to the junction blocks supported on a common display panel. Adjacent blocks can be connected to desired terminals from any of the various components mounted at the intersection. For instance, one block could be connected to the monitor terminal for phase one green and the adjacent terminal block could be connected to phase one green output terminal of the load switch. By merely placing a jumper between those two adjacent blocks, the monitor may be connected to the phase one green circuit for the purposes of monitoring the same. If there is to be no monitoring, the jumper between the two adjacent junction blocks can be removed. Thus, by a simple mechanical interconnection between two exposed junction blocks, two terminals of positionally spaced components can be connected or disconnected. At the common display panel, various terminals from several distinct components are terminated and exposed for manipulation of electrical interconnections by a traffic engineer. The junction blocks can be grouped in a manner which would generally allow a selected jumper to tie together two or more companion terminals. However, various other jumpers and interconnections can be made on the display panel itself for providing the desired hardwired program for the intersection. By providing a terminal board having a plurality of exposed, closely spaced junction blocks, a traffic engineer can provide interconnection by jumping the various junction blocks without actually rewiring the various components. To facilitate this arrangement, the various junction blocks can be labeled with terminal designations. Of course, there could be a separate sheet indicating which terminals are exposed at the various junction blocks located at the common display panel for subsequently modifying the interconnection of various terminals. This interleaving of the terminals from various components at the junction blocks on a common display panel allows modification of the operation of the intersection while retaining the advantages of having a prewired system. Only small jumpers are needed to modify the operation of the total unit at the intersection.

In accordance with another aspect of the invention, the method, as defined above, is accomplished by providing a number of groups of junction blocks, with each block being fixed on a common display panel and including a first element adapted to be permanently wired to a selected one of the terminals of the various components, a connector receiving second element adapted to be connected to the second element of another block of the same display panel and means for electrically connecting the first element and the connector receiving second element of each junction block. In this manner, the use of small interconnecting elements can be used at the display panel to change the program of the traffic control unit formed from several interconnected components at the intersection.

By utilizing the method and device of the invention, the various terminals of the different components are grouped together at the common display panel. Irrespective of the number of different devices employed at the intersection, the junction blocks can be grouped in accordance with the desired interconnection of the various terminals at the time of assembly and before shipment.

The primary object of the present invention is the provision of a method of allowing for manual connection of electrical terminals of separate devices used jointly to control signals displayed at a traffic intersection and a traffic control unit for practicing this method, which method and unit combine the advantages of fixed or permanently positioned interconnecting wiring and the advantages of manually shiftable interconnecting wiring.

Another object of the present invention is the provision of a method and unit, as defined above, which method and unit allows for manual programming by a traffic engineer in the field without using expensive harnesses and changeable interconnecting wire connections between the various components of the traffic control unit.

Another object of the present invention is the provision of a method and unit, as defined above, which method and unit employ a common display panel having exposed junction blocks matching actual terminals of the various components.

Another object of the present invention is the provision of a method and unit, as defined above, which method and unit has junction blocks for several components that are grouped by functions and not by origin device or component of the various terminals connected to the junction blocks.

These and other objects and advantages will become apparent from the following description taken together with the accompanying drawings set forth in the section below.

BRIEF DESCRIPTION OF DRAWINGS

In the present application the following drawings are included:

FIG. 5 is a schematic view of a traffic pattern at an intersection;

FIG. 6 is a motion diagram illustrating the sequencing of signals at an intersection, as shown in FIG. 5;

FIG. 7 is a schematic view of the prior art to which the present invention is directed;

PREFERRED EMBODIMENT

Figure 1:
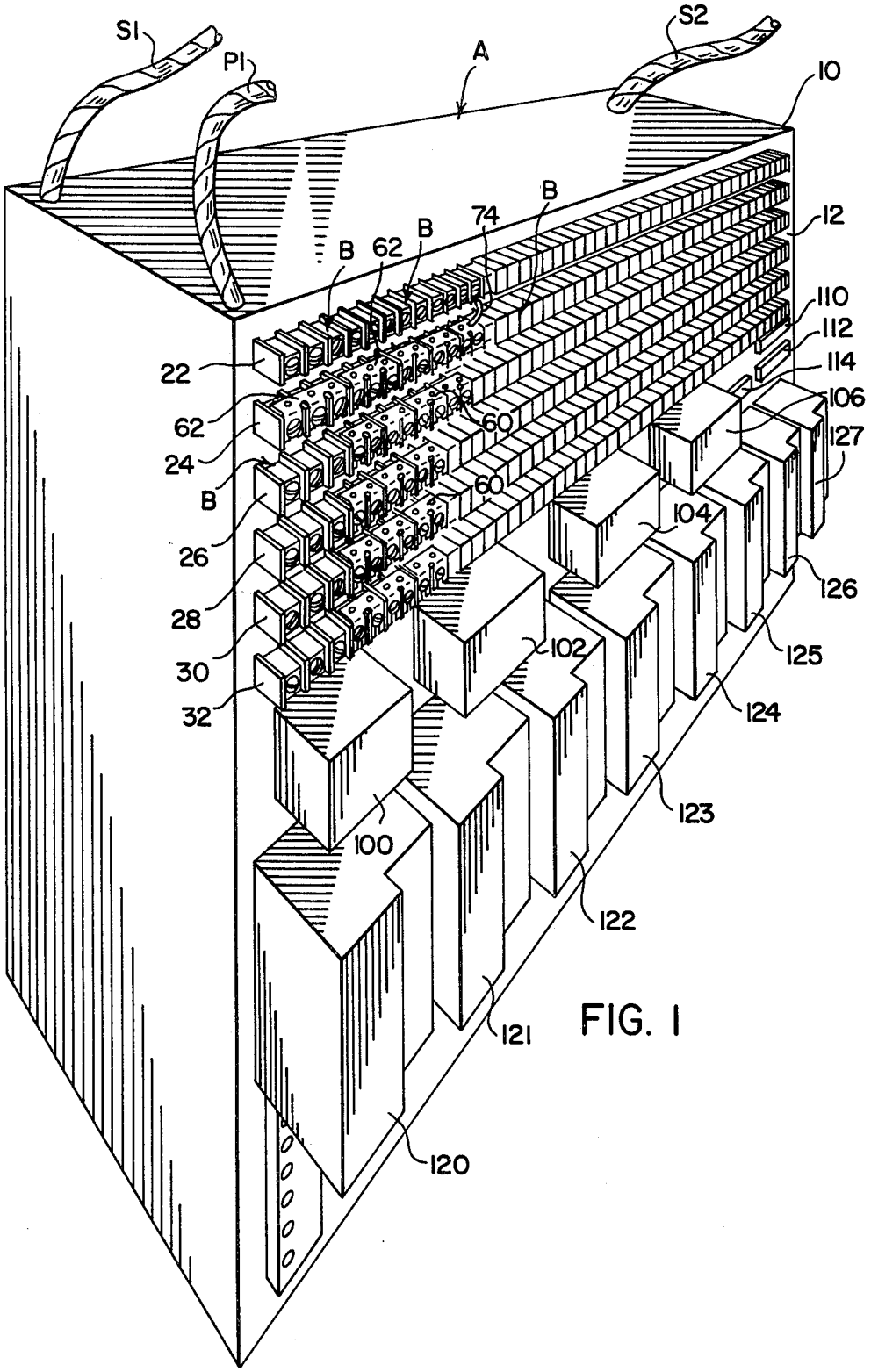
FIG. 1 is a pictorial view illustrating the preferred embodiment of the present invention.

Referring now to the drawings wherein the showings are for the purpose of illustrating a preferred embodiment of the invention only, and not for the purpose of limiting same, FIG. 1 shows a terminal board A of a traffic control unit of the type including at least a controller and a controller supervision device, such as a monitor or coordinator, together with load switches, electro-mechanical components and related elements necessary to be interconnected at an intersection to form a total traffic control unit. In the illustrated embodiment, terminal board A includes an appropriate support frame 10, schematically shown as a box; however, the support frame may take a variety of structural forms and is usually mounted in a cabinet so that a common display panel 12 is exposed for access by a traffic engineer. Within the same cabinet as board A, there is provided a controller having terminals, as set forth generally in FIG. 9, and connected to terminal board A by harnesses S1,P1. In a like manner, an appropriate monitor or other supervisory component is mounted in the cabinet containing terminal board A and is connected to the terminal board by an appropriate harness S2. Terminal board A, as will be apparent later, also supports several components, such as load switches, that combine to form a total traffic signal unit.

Figure 2:
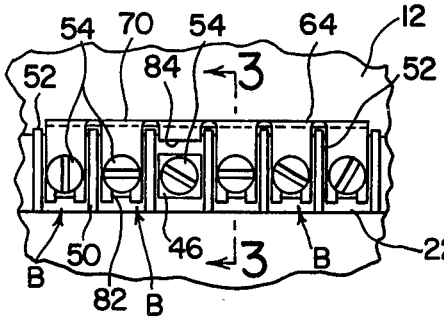
FIG. 2 is a partial view showing the junction block arrangement employed in the preferred embodiment of the invention.
Figure 3:
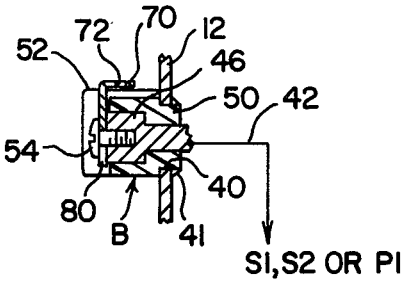
FIG. 3 is a view taken generally along line 3—3 of FIG. 2.
Figure 4:
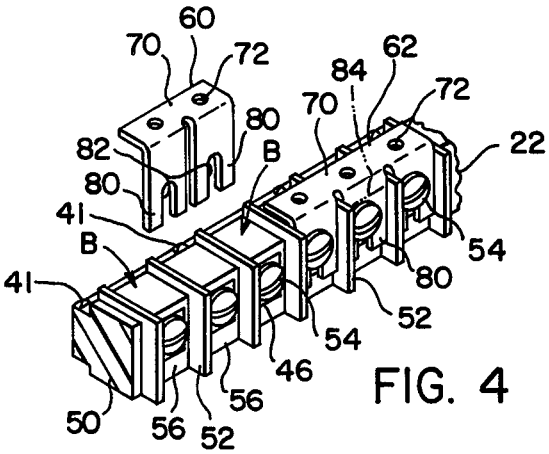
FIG. 4 is a pictorial view showing a modification of the interconnecting strap, as illustrated in FIG. 2.

In accordance with the invention, there are provided rows of junction blocks B secured onto and exposed at common display panel 12 so that a traffic engineer has access, both visual and manipulative, with each individual terminal block B. These blocks are best shown in FIGS. 2–4 and the rows are arranged as rows 22–32 shown in FIG. 1 and in FIGS. 8A, 8B. Referring now more particularly to FIGS. 2–4, junction blocks B of each row 22–32 are supported in an elongated opening 40 by a plurality of spaced detents 41. Each of the individual junction blocks B includes a conductive element 42 adapted to be connected permanently to a wire connected, in turn, to one of the terminals in groups S1, S2 or P1 shown in FIGS. 9 and 10. Blocks B also include connector receiving elements 46 embedded within an elongated insulation strip 50 having a plurality of spaced ribs or partitions 52. These partitions are between adjacent elements 46 so that these elements 46 define the individual junction blocks which are each permanently affixed by element 42 onto one of the several terminals. In addition, element 42 could be connected to an appropriate terminal of one of the other components mounted on terminal block A or other components combined at the intersection to form a total traffic control unit. Elements 46, each of which defines a terminal block, receive a screw or bolt 54, as best shown in FIG. 3. Thus, bolt 54, threadably received within connector receiving element 46, is used to make a connection at the exposed front of panel 12 with any one of the terminals permanently wired to an element 42. This structure defines each of the individual junction blocks B. As shown in FIG. 4, a block B includes a front face 56 between spaced ribs or partitions 52 of continuous insulation strip 50. This face, in practice, is imprinted by a silk screened designation of the particular terminal to which the junction block is permanently secured. These terminal designations are set forth in FIG. 9 when the block is attached to one of the terminals from a controller. When the terminal connected to a block is from a monitor, the terminal designation at face 56 is as set forth in FIG. 10. Other terminal designations for miscellaneous components are shown in FIGS. 8A–8D. As an example of the designation scheme used in practice, if a particular terminal block B is connected to terminal S1-H, this represents the $\phi$1 HOLD terminal. As shown in FIG. 9, this terminal is at junction block position or address A1. This address is the first row, i.e. 22, and the first junction block, i.e. 1. Consequently, this first junction block of row 22 in practice is labeled, on surface 56, with $\phi$1 HOLD. All blocks B are designated by a particular legend or inscription which identifies the terminal to which it is permanently attached from behind panel 12.

Figure 8A:
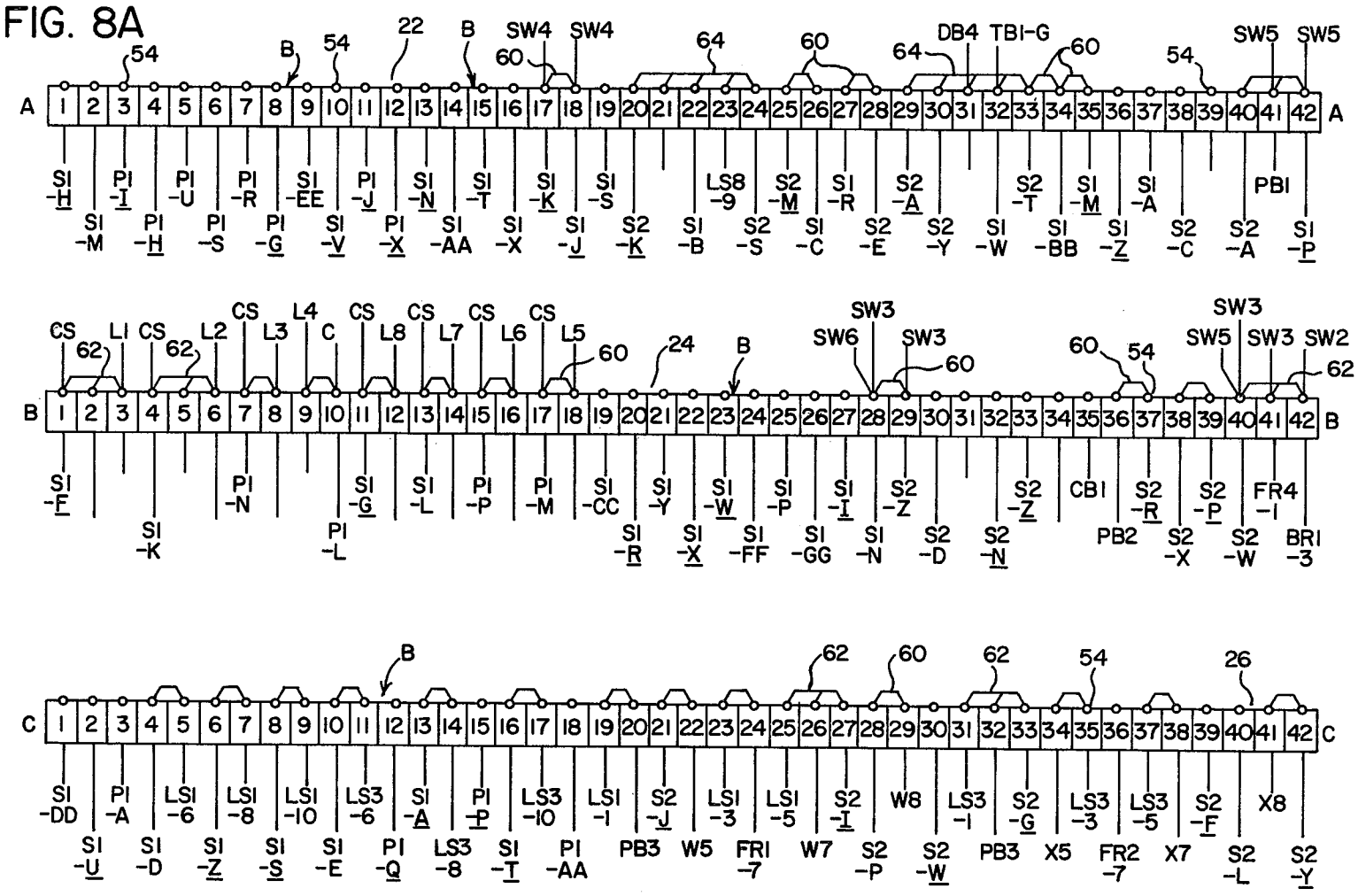
FIGS. 8A, 8B, 8C and 8D are to be taken together and illustrate a wiring interconnection scheme showing the preferred embodiment of the present invention in one mode of operation.
Figure 8B:
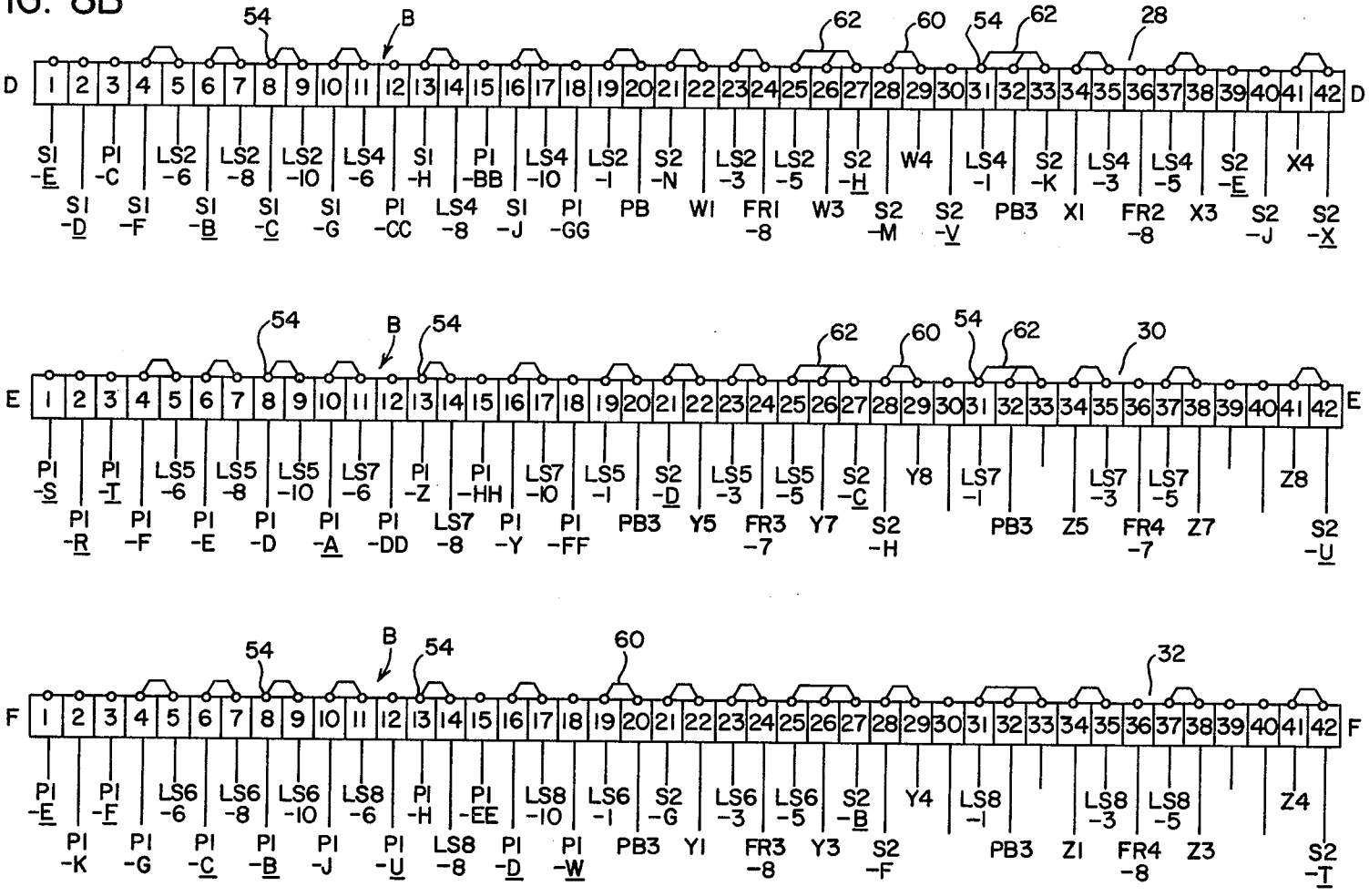
Figure 9A:
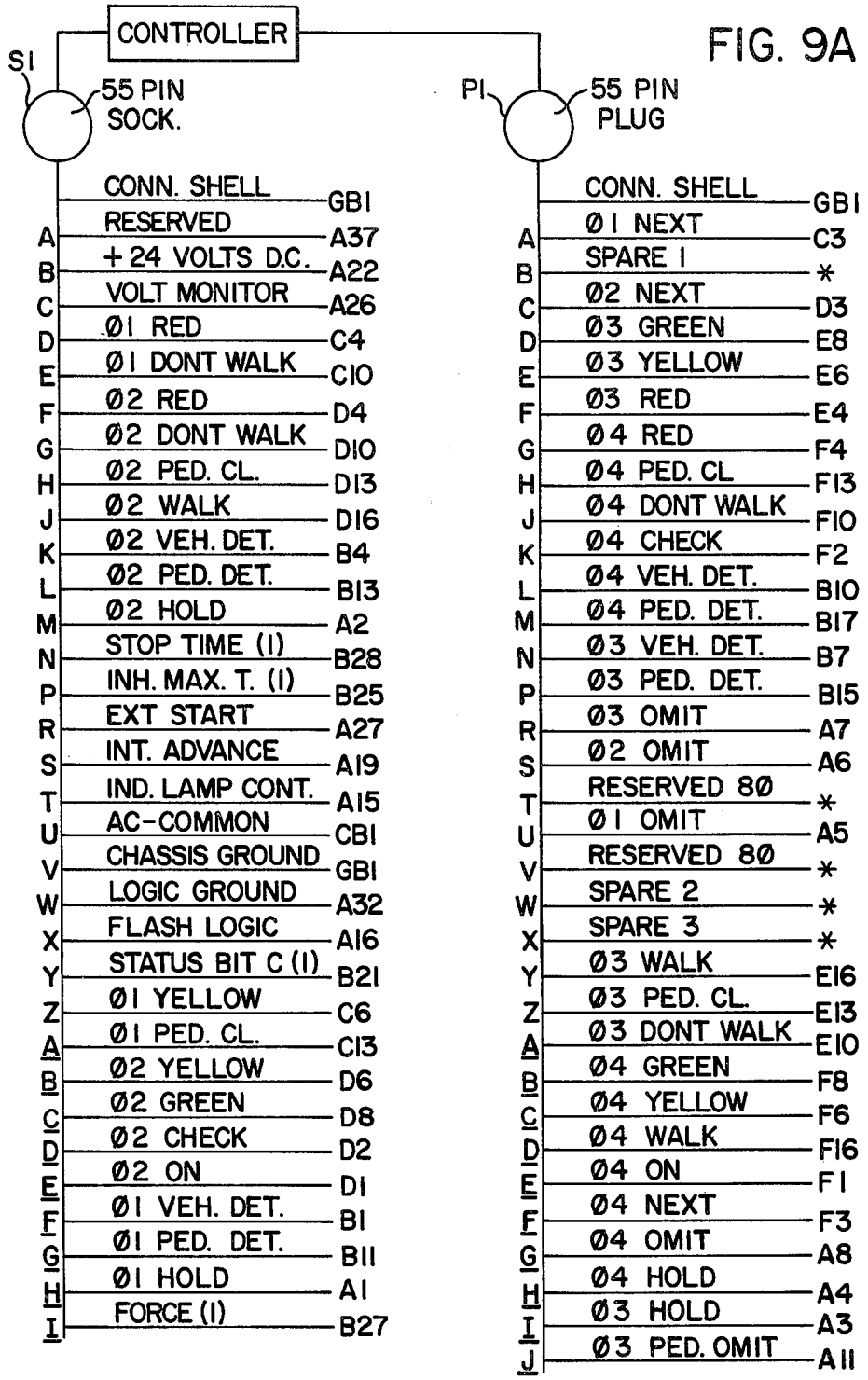
FIG. 9 (formed by sections 9A and 9B) is a terminal chart of a controller employed with the structure illustrated in FIGS. 8A–8D; and, FIG. 10 (formed by sections 10A and 10B) is a chart similar to the chart shown in FIG. 9 illustrating the terminals of a traffic monitor employed in the illustrated embodiment of the invention as shown in FIGS. 8A–8D.
Figure 10A:
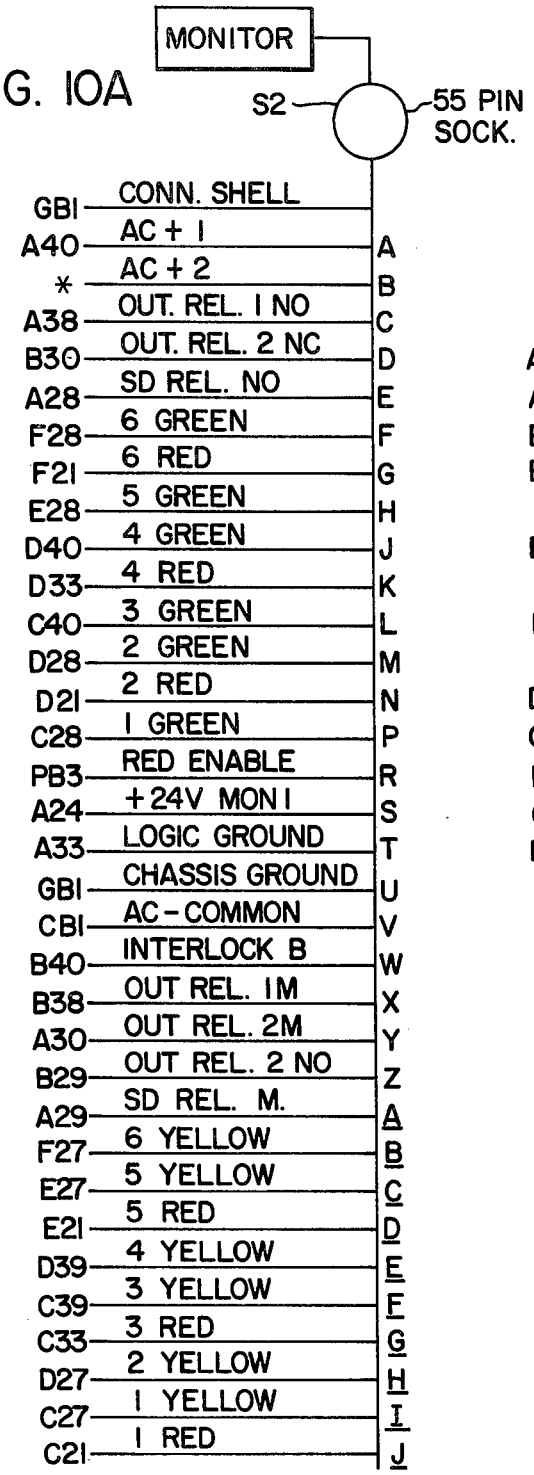
Figure 10B:
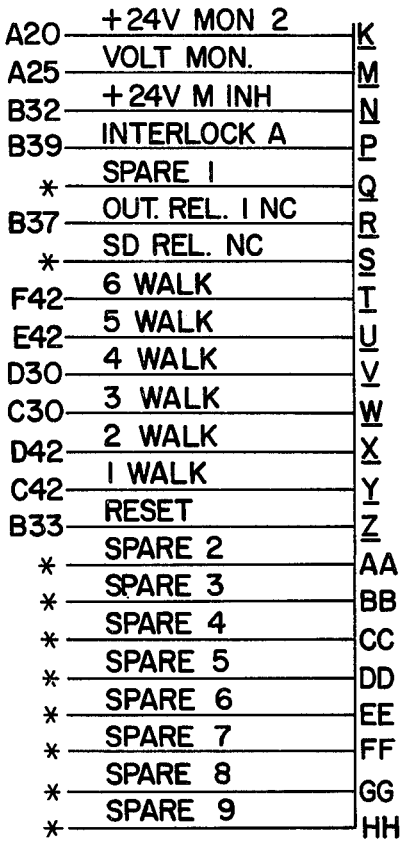

The separate junction blocks forming rows 22–32 as shown in FIGS. 1, 8A and 8B, are each permanently connected in electrical fashion with a selected terminal from a device which is also mounted adjacent an intersection. Mounting of blocks B on display panel 12 provides visual access to the many terminals comprising the total traffic control unit and provides physical, electrical access to each of these terminals. This novel terminal access concept has not been used in traffic control systems prior to the present invention. By connecting the various terminals permanently to selected junction blocks B from behind panel 12, the terminals which may ultimately be interconnected at the front of panel 12 can be grouped closely together. In other words, a terminal from the controller, as shown in FIG. 9, can be adjacent a terminal from the monitor, as shown in FIG. 10. Also a terminal from one of the other electrical components mounted on frame 10 can be connected to one of the junction blocks without being constrained by the origin of the terminal. These junction blocks thus provide electrical access to the various interconnections of the several units, which interconnections are made to control the interaction of the various components at the intersection to accomplish an integrated total traffic control unit.

In accordance with another aspect of the present invention, there is provided a particular arrangement for interconnecting adjacent junction blocks B. Referring now to FIGS. 1–4, electrical conductive sheet metal straps 60 are used to interconnect two adjacent junction blocks B. Similar sheet metal straps 62 are used to interconnect three adjacent junction blocks B. As is apparent, any number of adjacent junction blocks could be interconnected with a single electrically conductive strap similar to straps 60, 62. All of these other straps are schematically shown as multiple terminating straps 64 having structures for interconnecting several adjacent junction blocks B, six of which are shown in FIG. 2. In each of the electrically conductive straps there is provided a conductive strip 70 having pierced openings 72 for connecting a wire onto strip 70, if desired. A wire 74 for this purpose is schematically illustrated in FIG. 1. Spaced insert portions 80 depend from conductive strip 70 and include terminating slots 82 which are spaced from each other a distance corresponding to the spacing between adjacent screws or bolts 54. These slots fit over the bolts after they have been loosened. This secures conductive straps 60, 62 or 64 onto insulating strip 50 as shown in FIGS. 1–4. In this manner, the various terminal blocks are interconnected to provide interconnection of the terminals to which the various junction blocks are permanently connected. As shown in FIG. 2, it is possible to remove an insert portion 80 from a strap by cutting along edge 84. This removed insert or receiving portion is shown as missing in FIG. 2. The parting edge 84 is schematically illustrated in FIG. 4. Thus, if it is desirable at some later date to interconnect several adjacent blocks, except one, a traffic engineer can snip an insert connecting portion 80 from strap 64 corresponding with the desired junction block which is to be excluded from electrical interconnection. Various junction blocks can be selectively interconnected at display panel 12 on terminal board A. If at a later date the pattern of interconnected blocks is to be changed, this can be done by changing the various straps. Interconnecting wires could be also be connected between selected bolts or screws 54 for modification of the actual operating condition for the unit utilizing terminal board A.

Figure 8C:
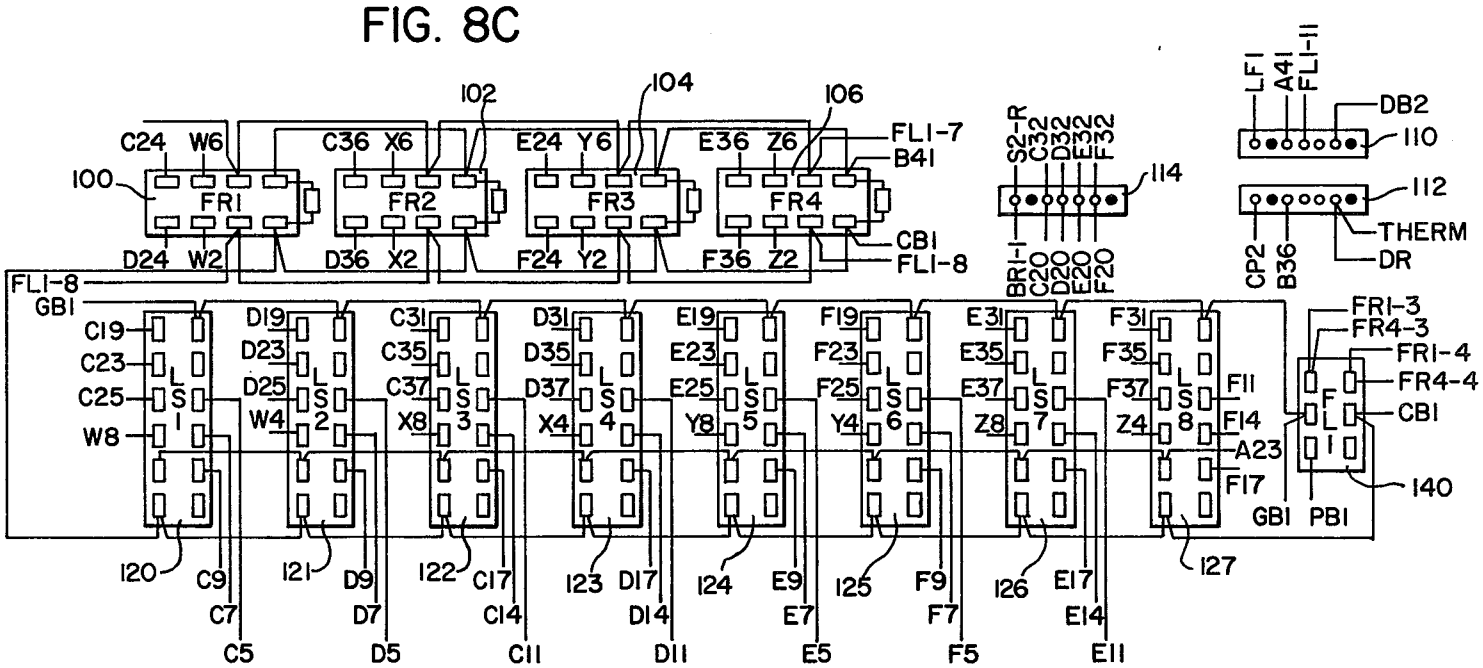
Figure 8D:
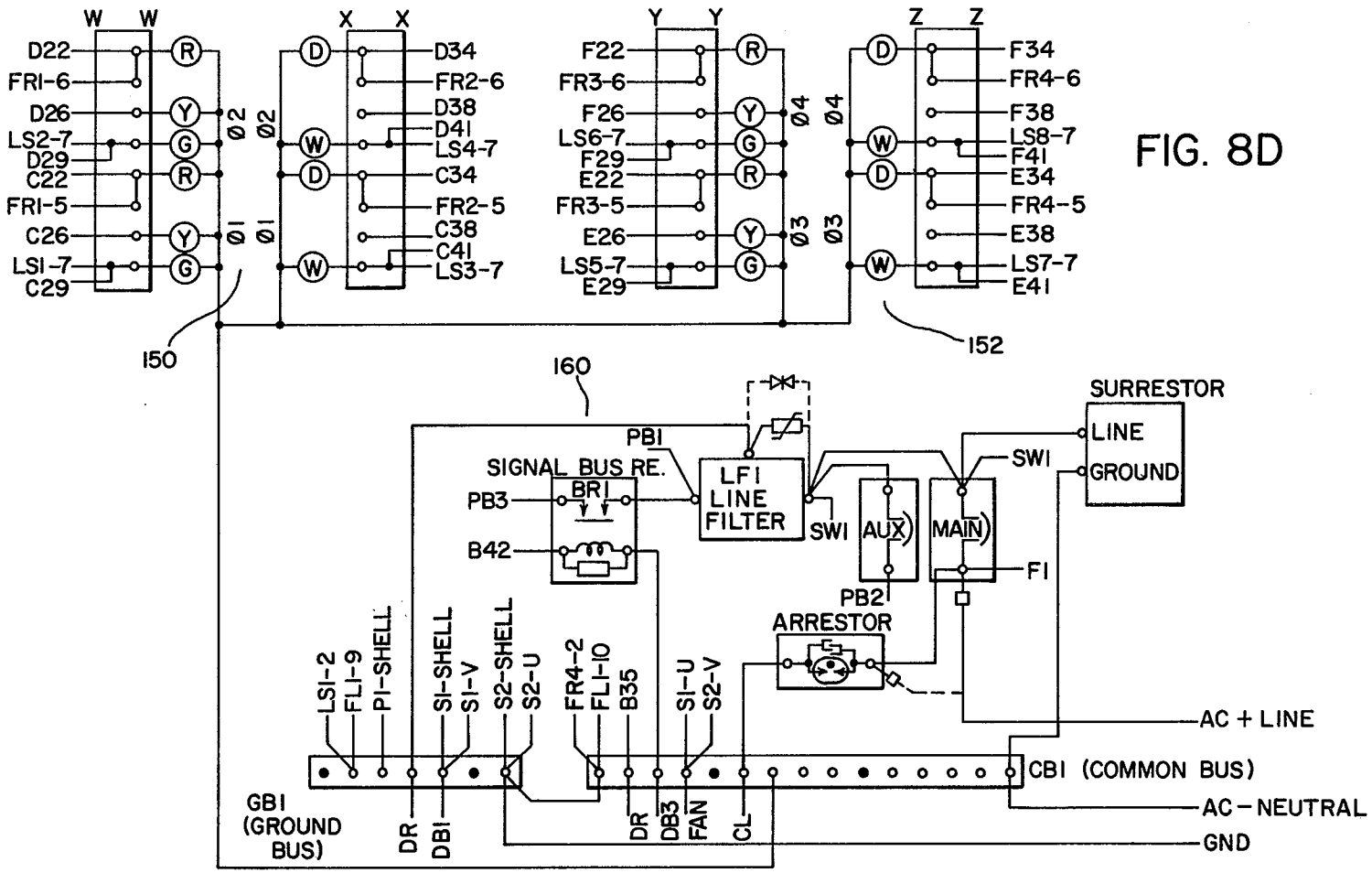

Referring now more particularly to FIGS. 1 and 8A–8D, it is contemplated in the preferred embodiment of the invention to mount standard flash relays 100–106 on support frame 10. In a like manner, terminal blocks 110, 112 and 114, as best shown in FIG. 8C, are secured onto the same support frame. Load switches 120–126, flashers 140, signal terminal blocks 150, 152 and miscellaneous control components 160 are all secured onto support frame 10 and each have a plurality of terminals which are permanently secured from behind panel 12 to selected ones of junction blocks B in rows 22–32. These interconnections are clearly illustrated in FIGS. 8A–8D, 9 and 10. Thus, the terminals of the various components on frame 10, together with terminals of an adjacent controller and monitor, are brought to and permanently secured with the various junction blocks B so that the junction blocks can be interconnected with appropriate straps or wires to modify their operating characteristics from the front of terminal board A.

PROGRAMMING AND WIRING

FIGS. 5 and 6 illustrate a standard intersection drawing and a movement diagram, respectively, for a traffic control unit of the type to which the present invention is particularly applicable. These diagrams illustrate the phases of movement and the signalization in accordance with standard practice. These diagrams are employed with FIGS. 8A–8D, 9 and 10 to illustrate one wiring connection pattern or mode using the preferred embodiment of the present invention as previously described. Before describing this programming or wiring, attention is directed to FIG. 7 which illustrates the prior art to which the invention applies. A cabinet 200 is used to house controller 202, monitor 204, various local switches and terminals 206 and various flashers and relays 208. These components each have terminals which are interconnected by a plurality of separate harnesses 210–218. As can be seen, if any of the interconnected terminals are to be changed or tied together, it is necessary to identify them and then run long wires or leads from one area of the cabinet to another area. This procedure is time consuming and expensive. Also, it is time consuming for a traffic engineer to find the various terminals and change the interconnections which are to be modified.

In accordance with the present invention, blocks B of rows 22–32, shown in FIGS. 8A and 8B, each includes a permanent connection to a terminal as labeled. Straps 60, 62 and 64 are used to interconnect junction blocks in a preselected pattern one of which is illustrated. Junction blocks B are addressed by letters (A–F) and numbers (1–42). As shown at various junction blocks B, more than one connection may be made. For instance, junction block B40 is connected to monitor terminal SW2 and also to switch terminals SW3, SW5. A strap 62 at junction block B40 interconnects junction block B40 with B41 and B42. B41 is permanently connected to flash relay terminal FR4-1 and switch SW3. In a like manner, terminal B42 is permanently secured or attached to terminal BR1:3 and switch SW2. These components are illustrated in FIGS. 8A–8D, 9 and 10. By combining these three drawings, one mode of permanently interconnecting junction blocks is illustrated. The temporary connections by the straps are schematically illustrated in FIGS. 8A–8D. To modify these interconnections, it is only necessary to change the straps between the various junction blocks. As can be seen in the preferred connection of a representative traffic control unit, adjacent blocks B may be connected to various components comprising the total traffic control unit. These may be modified in accordance with any desired grouping. Irrespective of the particular grouping, there is very little physical spacing between the various junction blocks on panel 12 as shown in FIG. 1 and FIGS. 8A, 8B. Rows 22–32 are spaced from each other less than about two inches and the length, which may vary, is less than about two feet. Thus, even interconnecting wires 74, when used between bolts 54 of the various blocks B or between straps connecting the blocks, will be relatively short and can be manipulated easily from the face of terminal board A. Thus, the major wiring is fixed or permanent behind board A in the present invention, whereas the various specific terminals may be selectively interconnected to program, in a hardwired fashion, the actual operating characteristics of the traffic control unit which includes the structure shown in FIG. 1 together with an appropriate controller and monitor, the terminals of which are schematically represented in FIGS. 9 and 10, respectively.

Having thus described the invention, the following is claimed:

1. In a traffic control unit for controlling signals displayed to at least two conflicting movements of traffic through an intersection, said control unit including a controller having a number of terminals controllable by applied voltages; load switches for controlling said displayed signals in response to voltages applied to certain load terminals of said load switches; mechanical signal controlling devices with input and output terminals; controller supervising devices having a number of control terminals; and means for allowing manual interconnection of selected ones of said terminals, the improvement comprising: said allowing means including (a) a number of rows of spaced junction blocks, with each block being fixed onto a common display panel and including an inactive coupling element adapted to be permanently wired to a selected one of said terminals, a connector-receiving element and means for electrically connecting said inactive element and said connector-receiving element; and, (b) a plurality of electrically separate means for electrically interconnecting selected ones of said connector-receiving elements of said junction blocks wherein said blocks on said common display panel are connected to selected terminals in a pattern not dictated by the pattern of terminals on origin devices of said terminals.

2. The improvement as defined in claim 1 wherein said interconnecting means are electrically conductive straps each having at least two longitudinally spaced insert portions with each of said insert portions being adapted to be connected to a connector receiving element of one of said junction blocks.

3. The improvement as defined in claim 2 wherein at least one of said electrically conductive straps includes an easily removable insert portion.

4. The improvement as defined in claim 2 wherein at least some of said interconnecting means are wires having a length necessary to connect desired junction blocks at said common display panel.

5. The improvement as defined in claim 1 wherein at least some of said interconnecting means are wires having a length necessary to connect desired junction blocks at said common display panel.

6. In a traffic control unit for controlling signals displayed to at least two conflicting movements of traffic through an intersection, said control unit including a first device having a number of terminals controllable by applied voltages; a second device for controlling said displayed signals in response to voltages applied to certain load terminals of said second device; a third, mechanical device for controlling traffic signals and having input and output terminals; a fourth device having a number of control terminals; and means for allowing manual interconnection of selected ones of said terminals, the improvement comprising: said allowing means including a number of groups of junction blocks, with each block being fixed onto a common display panel and including a first element adapted to be permanently wired to a selected one of said terminals, a connector-receiving second element adapted to be manually connected to the second element of another block at said panel and means for electrically connecting said first element and said connector-receiving second element of each of said junction blocks and wherein said blocks on said display panel are connected to selected terminals in a pattern not dictated by the patttern of terminals on said origin device of said terminals.

7. The improvement as defined in claim 6 further including a plurality of electrically separate means for electrically interconnecting selected ones of said connector receiving second elements of said junction blocks.

8. A method of allowing for manual connection in the field of electrical terminals of several separate and distinct electrical devices mounted at a selected location and used jointly to control signals displayed at a traffic intersection, said method comprising the steps of:

(a) fixing a number of junction blocks onto a common display panel;

(b) permanently connecting said terminals of said devices to selected ones of said junction blocks in a positional pattern not dictated by the pattern of terminals on origin devices of said terminals; and, (c) releasably and manually connecting selected ones of said junction blocks at said display panel to adjust the hardwired program of said separate and distinct electrical devices.

9. A terminal board for use with a traffic control unit for controlling signals displayed to at least two conflicting movements of traffic through an intersection, while control unit includes a first device having a number of terminals controllable by applied voltages; a second device for controlling said displayed signals in response to voltages applied to certain load terminals of said second device; a third, mechanical device for controlling traffic signals and having input and output terminals; a fourth device having a number of control terminals; and, means for allowing manual interconnection of selected ones of said terminals, wherein said allowing means includes a number of groups of junction blocks, with each block having a first element adapted to be permanently wired to a selected one of said terminals, a connector-receiving second element adapted to be connected to the second element of another block on said panel and means for electrically connecting said first element and said connector-receiving second element of each junction block wherein said blocks on said common display panel are connected to selected terminals in a pattern not dictated by the pattern of terminals on said origin devices of terminals.

* * * * *